US005572944A

United States Patent [19]

Slikkers et al.

[11] Patent Number: 5,572,944

[45] Date of Patent: Nov. 12, 1996

[54] BOAT HAVING STERN MOUNTED SWIM PLATFORM

[75] Inventors: David A. Slikkers; John A. Garland, both of Holland, Mich.

[73] Assignee: S2 Yachts, Inc., Holland, Mich.

[21] Appl. No.: 250,362

[22] Filed: May 27, 1994

[51] Int. Cl.[6] ..... B63B 17/00

[52] U.S. Cl. ..... 114/343; 114/362

[58] Field of Search ..... 114/343, 362, 114/364, 85

[56] References Cited

U.S. PATENT DOCUMENTS

| | | | |
|---|---|---|---|
| D. 280,080 | 10/1985 | Hegg et al. | D12/314 |
| 3,225,731 | 12/1965 | McCulley | 114/219 |
| 3,613,137 | 10/1971 | Eccles . | |
| 4,548,155 | 10/1985 | Hegg et al. | 114/362 |
| 4,742,795 | 5/1988 | DePrey et al. | 114/362 |
| 4,823,725 | 4/1989 | Smith | 114/343 |
| 4,907,673 | 3/1990 | Ginter et al. | 114/362 X |
| 5,094,640 | 3/1992 | Burdick et al. | 114/362 X |
| 5,293,832 | 3/1994 | Potter, Jr. | 114/362 |
| 5,349,919 | 9/1994 | Douglass | 114/85 |

OTHER PUBLICATIONS

J. Smith, Power and Motoryacht, Slickcraft 23755, Apr. 1988.

Tiara Yachts Catalog, 1994, p. 38.

*Primary Examiner*—Sherman Basinger

*Attorney, Agent, or Firm*—Varnum, Riddering, Schmidt & Howlett LLP

[57] ABSTRACT

A boat having a swim platform assembly mounted thereto is disclosed. The assembly has a top member and a bottom member assembled in a clam-shell manner. The interior of the swim platform assembly is hollow and preferably has a watertight seal. Preferably, a pair of projections are formed at the outboard corners of the swim platform which are received in complementary recesses formed in the stern of the boat hull. In addition, the aft portion of the bottom member is substantially planar and the bottom member is convex. The combination of the convex bottom member, interlocking projections and interlocking recesses results in a swim platform having enhanced strength, stability and buoyancy.

30 Claims, 5 Drawing Sheets

BOAT HAVING STERN MOUNTED SWIM PLATFORM

BACKGROUND OF THE INVENTION

1. Field of the Invention

This invention relates to boat having a swim platform mounted to the stern thereof, and more particularly, to a swim platform adapted to prevent swamping of the stern of the boat and provide added buoyancy for the stern.

2. Description of Related Art

A swim platform mounted to the stern of the boat is a desired feature for many boats. The platform often provides easy access onto and off of the boat. One problem typically encountered with stern mounted swim platforms arises when the speed of a boat moving forward through the water is suddenly reduced. A boat hull moving through water generates a following stern wake. When the speed is dramatically reduced, the bow rises, the stern digs deeper into the water and the stern wake may have sufficient momentum to flow up onto the swim platform. The added weight of the water on the swim platform forces the stern deeper into the water. Unless adequate measures are taken, the oncoming stern wake may be sufficient to enter the cockpit and in some cases swamp and sink the boat.

Another problem inherent with swim platforms are means for effectively mounting the swim platform in a rearwardly extending cantilever fashion from the stern of the boat. It is known to secure the forward end of a substantially planar swim platform to the stern of the boat by a plurality of brackets and to mount one end of a gusset arm to the aft end of the swim platform and the other arm to a lower portion of the stern. Problems inherent in this structure include the limited strength of this structure and the numerous holes which must be drilled into the hull in order to mount the multiple gusset arms and brackets. An example of a known swim platform is seen in U.S. Pat. No. 3,613,137 issued Oct. 19, 1971 to Eccles.

SUMMARY OF INVENTION

A boat having a stern mounted swim platform according to the invention overcomes these problems of the prior art by mounting a swim platform to the stern of a boat in a cantilevered fashion having a structure adapted to prevent water from flowing on top of the swim platform when a speeding boat is slowed and provide increased buoyancy for the stern of the boat in the face of an oncoming stern wave.

A swim platform assembly adapted to be mounted to the stern of a boat according to the invention comprises a forward wall and a rear edge spaced from the forward wall. A substantially planar top surface extends between the forward wall and the rear edge. A bottom surface extends between the forward wall and the rear edge and at least a portion of the bottom surface slopes upwardly from the forward wall toward the rear edge such that the swim platform is substantially thicker adjacent the forward wall than adjacent the rear edge. The swim platform assembly according to the invention is a functional support surface for persons climbing onto and off of the boat and deflects an approaching stern wave downwardly for a moving boat which is slowed suddenly.

In one embodiment, the sloping portion of the bottom surface is arcuate. Preferably, the sloping portion is convex.

In another embodiment, at least a portion of the swim platform is hollow and substantially watertight thereby providing increased buoyancy for the stern of the boat.

In another aspect, the invention encompasses a boat comprising a hull having a mounting wall and a swim platform mounted to the mounting wall. The swim platform comprises a front portion, an aft portion and a substantially planar top surface extending between the front and aft portions. A bottom surface, opposed to the top surface, extends between the front and aft portions and has a body intermediate the front and aft portions. At least a portion of the body of the bottom surface is contoured such that the front portion of the swim platform is thicker than the aft portion.

In one embodiment, the contoured portion of the bottom surface is convex.

In another embodiment, the swim platform comprises a port side edge and a starboard side edge and the bottom surface comprises an arcuate surface between the port and starboard side edges. Preferably, the arcuate bottom surface is convex.

In yet another embodiment, at least one exhaust outlet is formed in the boat adjacent the swim platform and at least one recess is formed in the bottom surface adjacent the at least one exhaust outlet. The recess is adapted to channel the exhaust away from the boat.

In still another embodiment, the stern has at least one mounting recess partially defined by an upper surface and the swim platform has at least one mounting projection extending therefrom. The at least one projection has a top surface and is received in the at least one recess such that the top surface of the at least one projection bears against the upper surface of the recess.

BRIEF DESCRIPTION OF THE DRAWINGS

The invention will now be described with reference to the drawings wherein.

DESCRIPTION OF THE PREFERRED EMBODIMENTS

Figure 1:
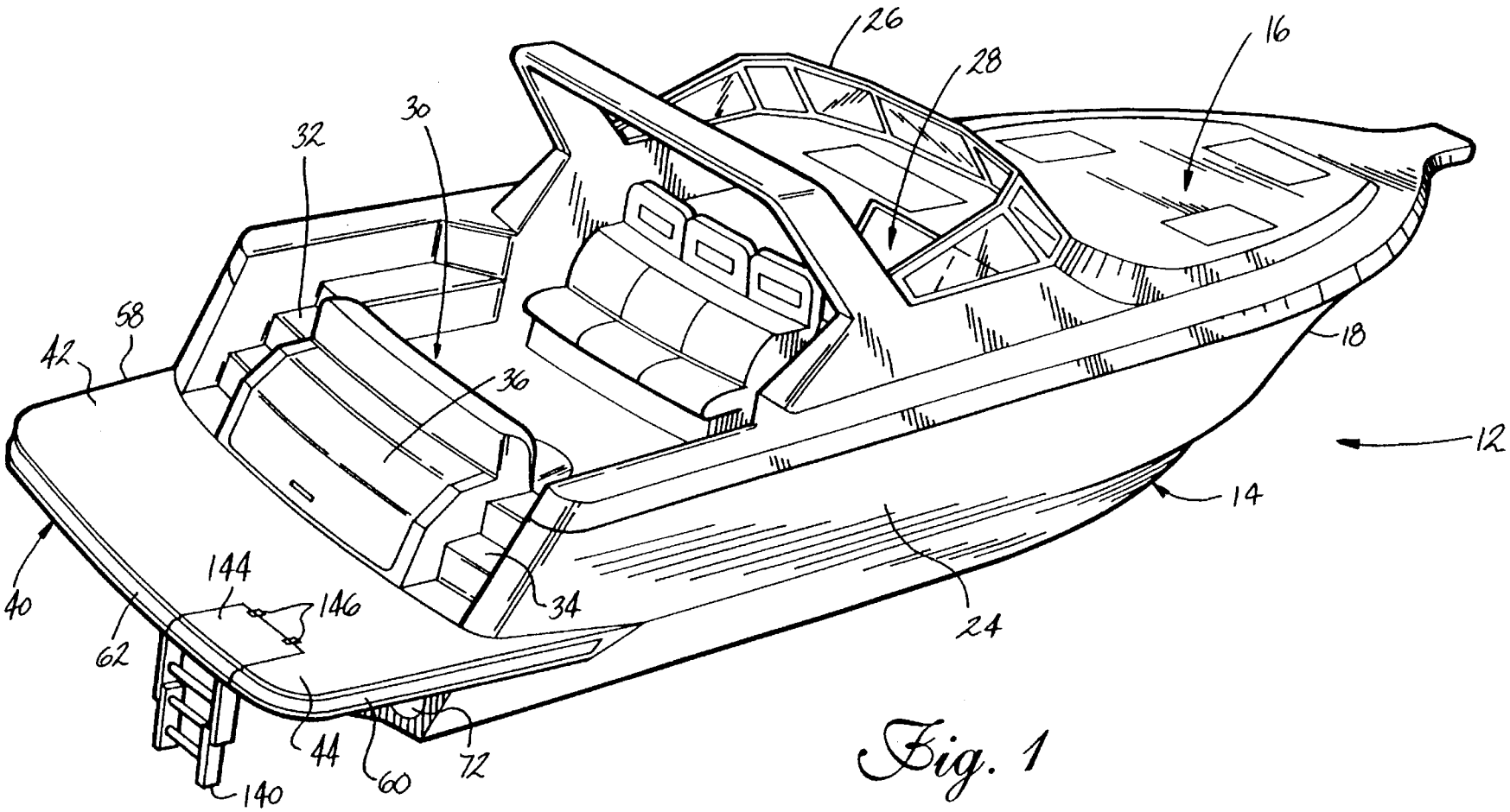
FIG. 1 is a rear perspective view of a boat having a swim platform assembly according to the invention mounted thereto.
Figure 4:
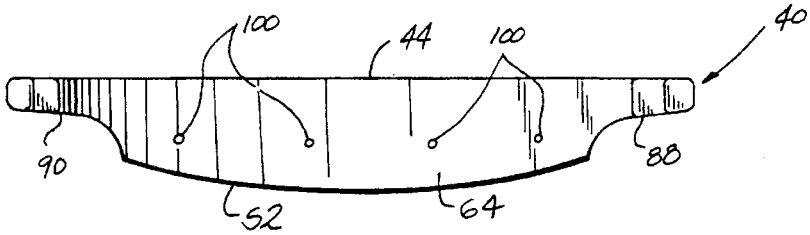
FIG. 4 is a front elevational view of the swim platform assembly according to the invention.

Referring now to the drawings and to FIG. 1 in particular, a boat 12 according to the invention comprises a hull 14 having a deck 16 mounted thereto. The hull comprises a bow 18, a stern 20 (FIG. 2), a port side 22 (FIG. 4) and a starboard side 24.

The deck 16 comprises a windshield 26, a helm position 28 and an aft cockpit area 30. Preferably, the aft cockpit area 30 includes a port and starboard walkway 32, 34, which provides access from the aft cockpit area 30 to a swim platform assembly 40 mounted to the stern 20 of the boat 12. A rear storage compartment 36 is preferably formed in the stern 20 of the boat 12 between the walkways 32, 34 and is accessible from the swim platform assembly 40. While the boat disclosed in FIG. 1 is an inboard, mid-cabin boat, any boat having a swim platform mounted thereto is within the scope of the invention.

As seen in FIGS. 1–4 and 7, the swim platform assembly 40 comprises a top member 42 having an external surface 44 and an internal surface 46 and a bottom member 48 having an external surface 50 and an internal surface (not shown). The swim platform assembly 40 is preferably constructed of fiberglass material and a suitable polyester resin. However, a wide variety of other conventional materials are suitable for the construction of the swim platform assembly.

The swim platform assembly 40 further comprises a port edge 58, a starboard edge 60, an aft edge 62 and a forward sidewall 64. Preferably, the swim platform assembly 40 spans the entire width of the stern of the boat. However, a swim platform assembly spanning less than the stern width is within the scope of the invention.

Figure 6:
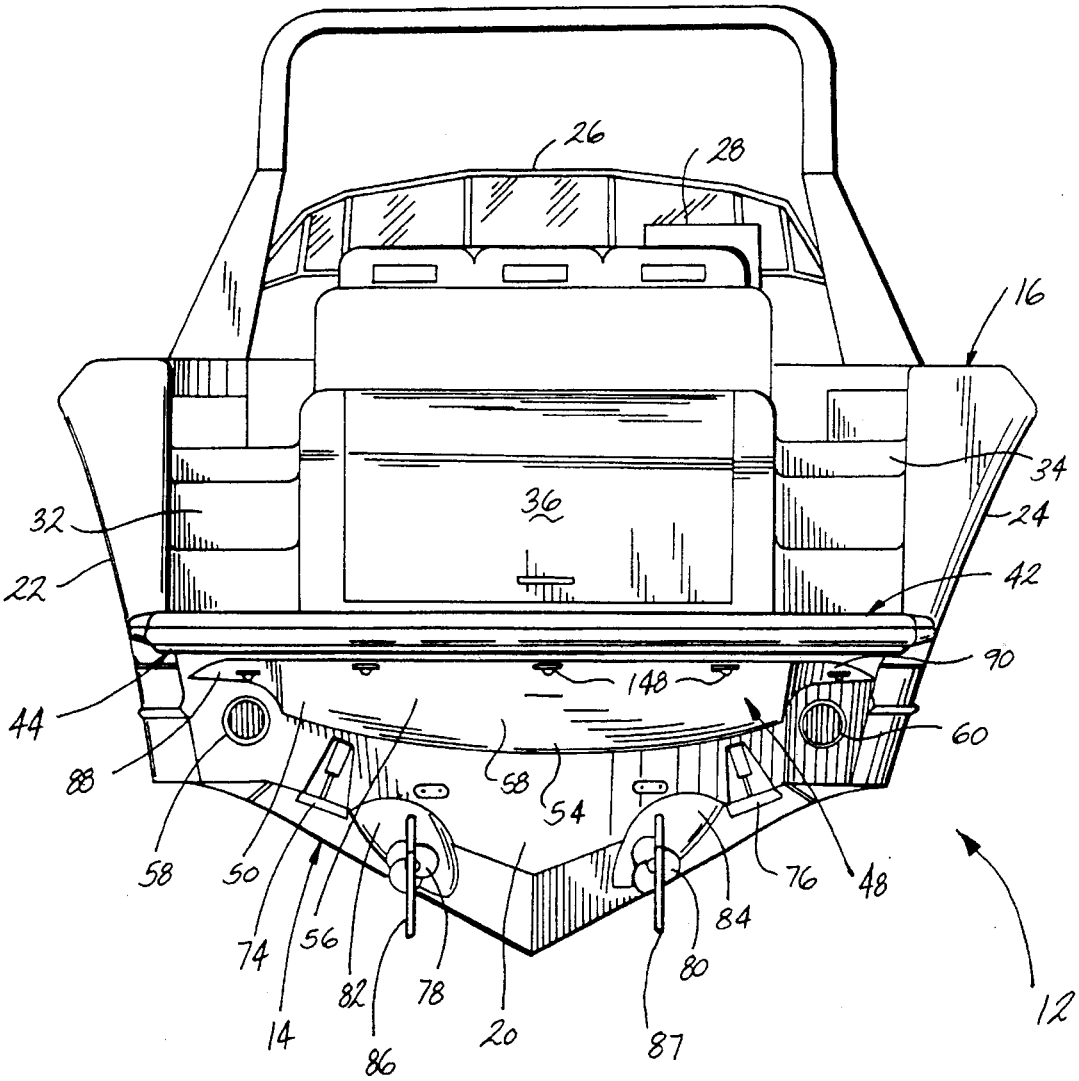
FIG. 6 is a rear elevational view of the boat of FIG. 1 having a swim platform assembly according to the invention mounted thereto.
Figure 7:
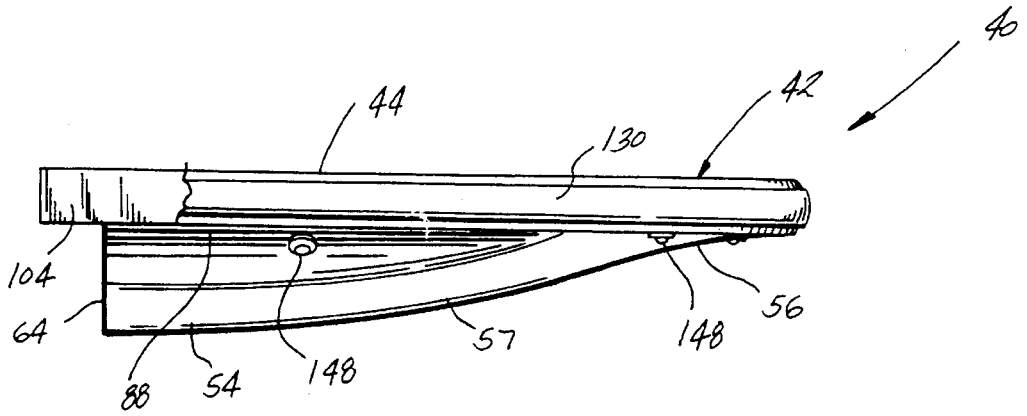
FIG. 7 is a side elevational view of a swim platform assembly according to the invention.

Preferably, the top member 42 of the swim platform assembly 40 is substantially planar while the bottom member 48 slopes upwardly from the forward sidewall to the aft edge such that the forward portion of the swim platform assembly 40 is substantially thicker than the aft portion. As seen more particularly in FIGS. 4, 6 and 7, the bottom member 48 is preferably arcuate both laterally and longitudinally. The lateral arcuate curve of a forward portion 54 of the bottom member 38 is substantially convex with the center point of the convex arc lying along the centerline of the boat. The lateral convex shape of the forward portion 54 is by no means a requirement of the invention. Other contours, such as a flat planar surface, a concave arc or a complex curve, are within the scope of the invention.

As described above, the forward portion 54 of the bottom member 38 is also preferably arcuate longitudinally. The main body portion 57 of the bottom member 48 cooperates with the forward portion 54 to create a concave arc which extends longitudinally over most of the bottom member 48. The main body portion 57 terminates in an aft portion 56 of the bottom member 48. The aft portion 56 is substantially planar and lies along a plane a spaced distance from the substantially planar top member 42. Once again, the substantially convex longitudinal shape of the bottom member is only the preferred contour, other suitable contours include a flat planar surface, a concave arc or a complex curve. Any of these contours are suitable provided that the forward portion of the swim platform assembly 40 is thicker than the aft portion.

Figure 2:
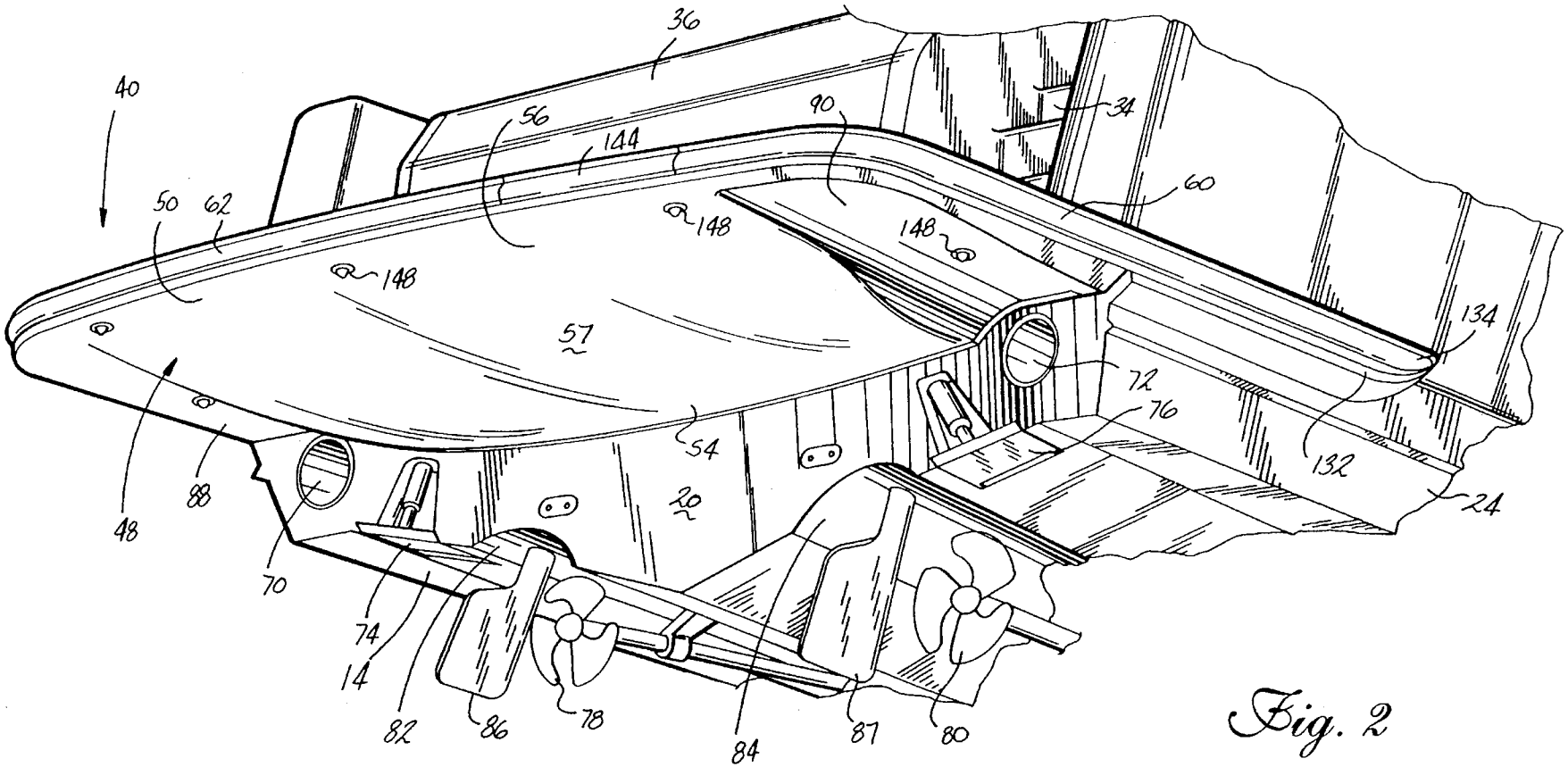
FIG. 2 is a lower perspective view of the stern of the boat of FIG. 1 having the swim platform assembly according to the invention secured thereto.

As seen in FIG. 2, the boat depicted herein is an inboard boat having port and starboard exhaust outlets 70, 72, port and starboard conventional trim tabs 74, 76, port and starboard conventional propeller drive shaft assemblies 78, 80, port and starboard propeller shaft tunnels 82, 84 formed on the underside of the hull and conventional port and starboard rudders 86, 87 extending downwardly from the hull 14.

The swim platform assembly 40 is mounted to the stern 20 of the boat 12 above the exhaust outlets 70, 72, trim tabs 74, 76 and propeller drive shafts 78, 80. Preferably, a port and starboard exhaust recess 88, 90 is formed in the bottom member 48 and adapted to channel exhaust exiting the exhaust outlets 70, 72 away from the aft cockpit area 30. The exhaust is channeled away from the aft cockpit area 30 thereby preventing passengers from breathing the noxious fumes. The recesses 88, 90 also help to direct the engine noise emanating from the exhaust outlets 70, 72 downwardly, away from the aft cockpit area 30.

Figure 3:
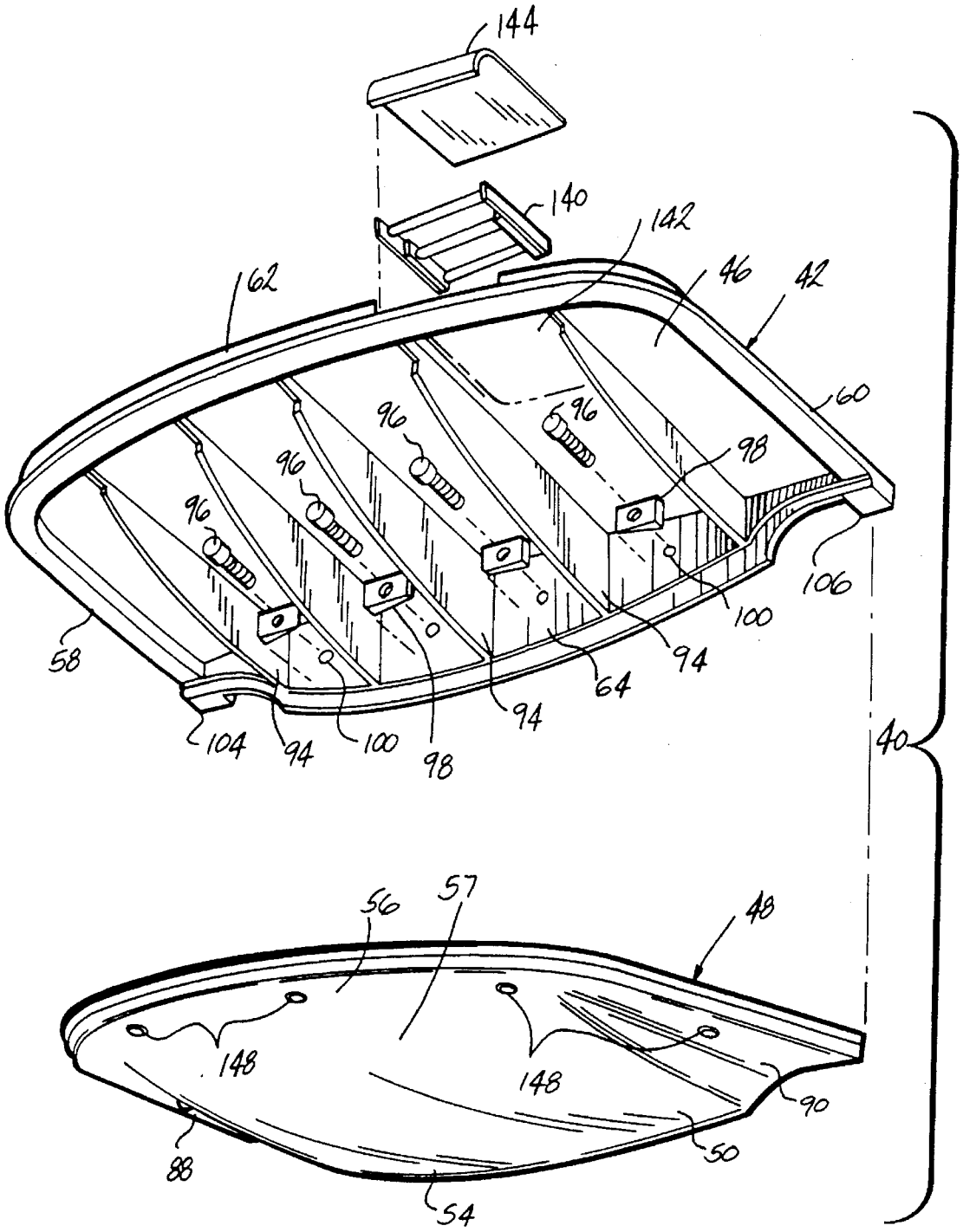
FIG. 3 is a lower perspective exploded view of the swim platform assembly according to the invention.

As seen in FIG. 3, a plurality of longitudinal support ribs 94 are mounted in the hollow interior of the swim platform assembly 40. One edge of the rib 94 is preferably integrally molded to the internal surface 46 of the top member 42. When the top and bottom members 42, 48 are assembled, the other edge of the support ribs 94 contact the internal surface of the bottom member 48 thereby enhancing the structural stability of the swim platform assembly 40 and defining between the top and bottom members 42, 48 a substantially hollow interior. Preferably, a conventional waterproof sealant is applied about the perimeter of the top and bottom members 42, 48, as the members are assembled thereby creating a substantially air-tight seal to prevent water from entering the hollow interior of the swim platform. The sealed construction of the swim platform having a hollow interior makes the assembly 40 buoyant.

In assembling the swim platform assembly 40, a plurality of conventional fasteners such as bolts 96 are inserted through suitable apertures formed in conventional mounting plates 98 and then the bolts 96 and mounting plates are spot welded to one another. Next the shafts of the bolts 96 are inserted through the bolt apertures 100 formed in the forward sidewall 64. The bolts 96 and mounting plates 98 are secured to the inside surface of the forward sidewall 64 by suitable means such as an adhesive putty. Next, the bottom member 48 is secured to the top member 42 by a conventional adhesive/sealant. As described above, the bottom edge of the support ribs 94 contact the inside surface (not shown) of the bottom member 48 when the bottom member 48 and top member 42 are assembled to one another. In this condition, the swim platform assembly is now ready to be mounted to the boat hull 14.

The primary means for securing the swim platform assembly 40 to the stern 20 of the boat 12 is the plurality of bolts 96. The bolts 96 extend through the apertures in the mounting plates 98 and through bolt apertures 100 formed in the forward sidewall 64 and are received in suitable apertures (not shown) formed in the stern 20. Additional mounting plates (not shown) and nuts (not shown) are mounted to the bolts from inside the hull thereby securing the swim platform assembly 40 to the boat 12. Once again, a conventional waterproof sealant is applied around the bolt apertures 100 to maintain the watertight integrity of the swim platform assembly.

The stern 20 is preferably a convex surface extending between the sides 22, 24. The forward side wall 64 of the swim platform assembly is concave, complementary to the arcuate shape of the stern 20. Despite the arcuate surfaces of the stern 20 and forward sidewall 64, it is preferred to mount the bolts 96 parallel to the centerline of the boat. Therefore, the mounting plates 98 are preferably wedge-shaped to compensate for the arcuate surfaces of the stern 20 and forward sidewall 64 of the swim platform assembly 40.

Figure 5:
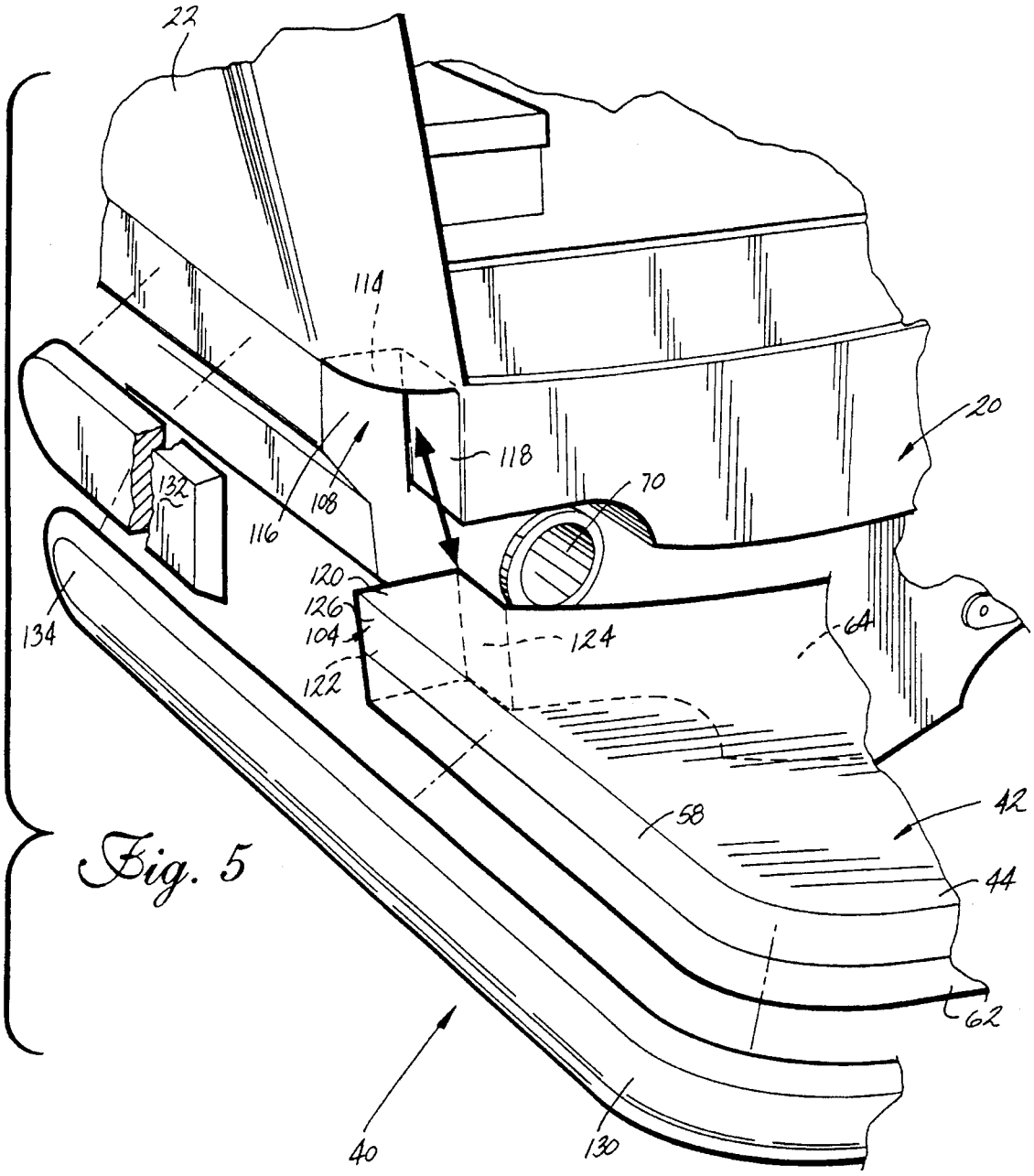
FIG. 5 is an exploded rear perspective view of the interlocking structure of the stern of the boat and swim platform assembly according to the invention.

Additional means for securing the swim platform assembly 40 to the boat 12 are seen in FIG. 5. A pair of mounting projections extend outwardly from the forward sidewall 64 of the swim platform assembly 40 and are adapted to be received in complementary mounting recesses formed in the stern 20 of the boat 12. Preferably, the projections comprise a port mounting projection 104 and a starboard mounting projection 106 which are formed at the outboard corners of the swim platform assembly 40. A port mounting recess 108 and a starboard mounting recess (not shown) are formed at the port and starboard corners of the stern 20. The structure of the recesses and projections are identical and therefore only the port mounting projection 104 and recess 108 are depicted in FIG. 5 and will be described in detail.

The port mounting recess 108, as seen in FIG. 5, is defined by a top wall 114, a forward wall 116 and a sidewall 118. The recess 108 is dimensioned to receive the forwardly extending mounting projection 104 which comprises a top wall 120, a forward wall 122, an inside wall 124 and an outside wall 126. In the assembled position, the forward sidewall 64 of the swim platform assembly 40 abuts the stern 20, the top wall 120 of the mounting projection 104 abuts the top wall 114 of the recess 108, the forward wall 122 of the mounting projection 104 abuts the forward wall 116 of the recess 108 and the inside wall 124 of the mounting projection 104 abuts the sidewall 118 of the recess.

In light of the cantilevered mounting of the swim platform assembly to the stern 20 of the boat, the swim platform assembly 40 and the means for mounting the assembly to the boat must have sufficient strength to withstand the lever action exerted on the swim platform when a passenger steps on the aft portion of the swim platform. The engagement of the mounting projections and recesses adds to the strength and stability of the swim platform assembly 40. First, the abutting engagement between the sidewall 118 of the recess and the inside wall 124 of the projection on both outside corners of the swim platform assembly 40 prevents lateral movement of the swim platform assembly 40 with respect to the hull 14 of the boat 12. Next, the combination of the convex forward portion 54 of the bottom member 48 and the abutting engagement of the walls of the projections with the walls of the recesses on both the outside corners of the swim platform assembly creates a tripod structure which provides enhanced strength for supporting weights on the swim platform. Therefore, the swim platform assembly can extend significantly further aft from the stern 20 of the boat 12 compared to prior swim platforms and results in a high strength-to-weight ratio for the swim platform assembly 40.

As also seen in FIG. 5, a rub rail 130 and contoured member 132 are preferably mounted to the hull 14 and the outside perimeter of the swim platform assembly 40 so as to substantially surround the edge of the assembly 40. The structure and assembly of the rub rail 130 and contoured member 132 is identical for both the port and starboard side of the boat and therefore only the port side is depicted in FIG. 5 and will be discussed herein. The contoured member 132 and the leading edge 134 of the rub rail 130 are mounted to the side of the hull 14 by conventional fasteners and adhesive sealants immediately forward of the mounting recess 108. After the swim platform has been attached to the stern of the boat 12, the body of the rub rail 130 is securely mounted to the outside wall 126 of the projection 104, the port edge 58 and the aft edge 62. The rub rail 130 is preferably formed of an elastomeric material which will resist damage to the swim platform by contact with other boats, dinghies, docks and the like. In addition, a decorative design or metallic layer can be applied to the rub rail 130.

The swim platform assembly 40 according to the invention can also include other desirable features. For example, as seen in FIGS. 1 and 3, a swim ladder 140 can be pivotally mounted to the aft edge 62 of the swim platform assembly 40. Preferably, the swim ladder 140 is a conventional multi-section fold down swim ladder which can be extended outwardly to a first position as seen in FIG. 1 or retracted to a second position as seen in FIG. 3. In the extended position, the ladder 140 extends downwardly into the water so that swimmers, divers and the like can easily board the swim platform assembly 40 from the water. In the retracted position, the swim ladder 140 can be pivoted upwardly about the aft edge 62 of the swim platform assembly 40 and be received in a swim ladder recess 142 formed in the top member 42. The swim ladder recess 142 is merely a depression in the external surface 44 of the top member 42 such that the fold down swim ladder 140 is not received in the hollow interior of the swim platform assembly 40. Therefore, the watertight integrity of the swim platform assembly 40 is maintained. A recess cover 144 is pivotally mounted to the external surface 44 of the top member 42 by a pair of conventional hinges 146 thereby enclosing the swim ladder recess 142.

Yet another desireable amenity for the swim platform assembly 40 according to the invention comprises a plurality of conventional waterproof lights 148 mounted to the external surface 50 of the bottom member 48. A conventional electrical conduit (not shown) extends from the source of electricity in the boat 12 to each of the lights 148. The lights are ideal when swimming or diving from the swim platform assembly 40 at night. While the lights of the preferred embodiment are shown mounted in the bottom member 48, the lights can also be mounted in the top member 42 or in both the top and bottom members 42, 48.

The swim platform assembly according to the invention provides significant advantages over prior art swim platform assemblies. First, the structure of the swim platform assembly, namely the convex bottom member and mounting projections and recesses provides for a surprisingly strong swim platform assembly. This structure can support an unusually large amount of weight cantilevered from the stern of the boat 12. Secondly, the structure reduces the chances of the following stern wake from entering the aft cockpit area. As the speeding boat slows, water from the stern wake flows underneath the swim platform assembly. The water engages the arcuate bottom member 48 and is deflected downwardly thereby providing an upward force against the stern of the boat 12. If, for some reason, water were to get on top of the swim platform assembly 40, the buoyant hollow interior of the swim platform assembly 40 will resist the weight and downward force exerted by the stern wake. As noted above, the swim platform assembly according to the invention can be mounted on any boat upon which a stern mounted swim platform assembly is desireable.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments of the invention in which an exclusive property or privilege is claimed are defined as follows:

1. A swim platform adapted to be mounted to the stern of a boat having a bow and port and starboard sides extending between the bow and the stern, said swim platform comprising:

a forward wall;

a rear edge spaced from the forward wall;

a substantially planar top surface extending between the forward wall and the rear edge; and a bottom surface extending between the forward wall and the rear edge, at least a portion of the bottom surface sloping upwardly from the forward wall toward the rear edge so that the swim platform is substantially thicker adjacent the forward wall than adjacent the rear edge and at least a portion of the bottom surface is convex both laterally and longitudinally so that water striking said portion of the bottom surface is diffused into multiple directions.

2. A swim platform according to claim 1 wherein at least a portion of the swim platform is hollow and substantially watertight.

3. A swim platform according to claim 1 and further comprising at least one recess formed in the bottom surface, the recess being adapted to channel exhaust away from an exhaust outlet in a boat.

4. A swim platform according to claim 1 and further comprising at least one light mounted in at least one of the top and bottom surfaces of the swim platform.

5. In a boat comprising a hull having a bow, a stern, port and starboard sides extending between the bow and the stern, and a swim platform mounted to the stern, the improvement comprising;

the swim platform having a forward portion, a rear edge spaced from the forward portion, a top surface extending between the forward portion and the rear edge and a bottom surface extending between the forward portion and the rear edge, at least a portion of the bottom surface sloping upwardly from the forward portion toward the rear edge so that the swim platform is substantially thicker adjacent the forward portion than adjacent the rear edge and at least a portion of the bottom surface is convex both laterally and longitudinally so that water striking said portion of the bottom surface is diffused into multiple directions.

6. A boat according to claim 5 further comprising at least one exhaust outlet formed in the boat adjacent the swim platform and at least one recess formed in the bottom surface adjacent an exhaust outlet, the recess channelling the exhaust away from the boat.

7. A boat according to claim 5 further comprising a folding swim ladder pivotally mounted to the swim platform, the swim ladder being extended to a first position and retracted to a second position.

8. A boat according to claim 5 and further comprising a swim ladder pivotally mounted to the swim platform for movement between first and second positions and a ladder depression formed in the top surface of the swim platform to receive the swim ladder in one of the first and second positions.

9. A boat according to claim 8 and further comprising a cover mounted to the swim platform in a position to enclose the swim platform depression.

10. A boat according to claim 5 wherein at least a portion of the swim platform is hollow and substantially watertight.

11. A boat according to claim 10 further comprising at least one rib mounted in the hollow portion of the platform and extending between the top and bottom surfaces whereby the rib provides additional structural support for the swim platform.

12. A boat according to claim 10 wherein the swim platform is mounted to the boat by a plurality of fasteners adapted to engage the forward portion and the stern for securely mounting the swim platform to the stern of the boat.

13. A boat according to claim 12 wherein the stern of the boat and the forward portion of the swim platform are arcuate and further comprising mounting members mounted between the fasteners and the forward portion, the mounting members being wedge-shaped to compensate for the arcuate shape of the forward portion and stern wherein the wedge-shape is dimensioned so that the fasteners are substantially parallel to a centerline of the boat.

14. A boat according to claim 5 wherein the stern has at least one mounting recess partially defined by an upper surface and the swim platform has at least one mounting projection extending therefrom and having a top surface, the at least one mounting projection being received in the at least one recess such that the top surface of the at least one projection bears against the upper surface of the recess.

15. A boat according to claim 14 wherein the boat further comprises a port corner formed at the junction of the port side and the stern, and a starboard corner formed at the junction of the starboard side and the stern, one of the at least one mounting recesses being formed in the port corner, and another of the at least one mounting recesses being formed in the starboard corner and one of the at least one projections being mounted to the swim platform such that it is received in the one recess and another of the at least one mounting projections being mounted to the swim platform such that it is received in said another recess.

16. A boat according to claim 5 and further comprising at least one light mounted in at least one of the top and bottom surfaces of the swim platform.

17. A boat according to claim 5 wherein the swim platform further comprises a port edge, a starboard edge, the rear edge extending between the port and starboard edges and further comprising a rub rail member mounted to the port, starboard and rear edges of the swim platform.

18. A boat according to claim 17 wherein the rub rail member is also mounted to at least a portion of the port and aft sides of the boat.

19. A boat comprising:

a hull having a mounting wall;

a swim platform mounted to the mounting wall, the swim platform comprising:

a front portion;

an aft portion;

a substantially planar top surface extending between the front and aft portions;

a bottom surface opposed to said top surface, extending between the front and aft portions, and having a body intermediate the front and aft portions of the swim platform, at least a portion of the body of the bottom surface being contoured such that the front portion of the swim platform is thicker than the aft portion; and at least one exhaust outlet formed in the boat adjacent the swim platform and at least one recess formed in the bottom surface adjacent the at least one exhaust outlet, the recess being adapted to channel the exhaust away from the boat.

20. A boat according to claim 19 wherein said contoured portion of the bottom surface is arcuate.

21. A boat according to claim 20 wherein the arcuate portion of the bottom surface is convex.

22. A swim platform according to claim 21 wherein at least a portion of the swim platform is hollow and substantially watertight.

23. A swim platform according to claim 22 and further comprising at least one support rib mounted in the hollow portion of the swim platform and extending between the top and bottom surfaces.

24. A boat according to claim 19 wherein at least a portion of the swim platform is hollow and substantially watertight.

25. A boat according to claim 19 and further comprising at least one light mounted in at least one of the top and bottom surfaces of the swim platform.

26. A boat comprising:

a hull having a mounting wall;

a swim platform mounted to the mounting wall, the swim platform comprising:

a front portion;

an aft portion;

a substantially planar top surface extending between the front and aft portions;

a bottom surface opposed to said top surface, extending between the front and aft portions, and having a body intermediate the front and aft portions of the swim platform, at least a portion of the body of the bottom surface being contoured so that the front portion of the swim platform is thicker than the aft portion; and at least one mounting recess provided in the mounting wall, the at least one recess being partially defined by an upper surface and the swim platform has at least one mounting projection extending therefrom, the at least one projection having a top surface and being received in the at least one recess so that the top surface of the at least one projection bears against the upper surface of the at least one recess.

27. A boat according to claim 26 and further comprising a swim ladder pivotally mounted to the swim platform for movement between first and second positions, a ladder depression formed in the top surface of the swim platform to receive the swim ladder in one of the first and second positions, and a cover mounted to the swim platform in a position to enclose the swim platform recess and ladder.

28. A boat according to claim 26 wherein said contoured portion of the bottom surface is convex.

29. A boat according to claim 26 and further comprising at least one light mounted in at least one of the top and bottom surfaces of the swim platform.

30. A boat according to claim 26 wherein at least a portion of the swim platform is hollow and substantially watertight.

* * * * *